United States Patent [19]

Voss et al.

[11] 4,195,587

[45] Apr. 1, 1980

[54] SHEET CLEAT HAVING MOVABLE GRIPPING JAWS

[75] Inventors: Gunter M. Voss, Steingrabenstr. 28, D-8036 Herrsching-Breitbrunn; Herbert Schneider, Tutzing, both of Fed. Rep. of Germany

[73] Assignee: Gunter M. Voss, Herrshing-Breitbrumn, Fed. Rep. of Germany

[21] Appl. No.: 927,316

[22] Filed: Jul. 24, 1978

[51] Int. Cl.[2] ..... B63B 21/04

[52] U.S. Cl. ..... 114/218; 114/101; 24/134 R

[58] Field of Search ..... 114/218, 101, 199; 188/65.1-65.5; 24/115 R, 115 L, 122.3, 122.6, 127, 132 R, 132 AA, 132 WL, 133, 134 R, 134 KA, 134 KB, 134 L, 134 N, 134 P

[56] References Cited

U.S. PATENT DOCUMENTS

| | | | |
|---|---|---|---|
| 410,687 | 9/1889 | Gibson | 24/134 R |
| 3,265,032 | 8/1966 | Hume | 114/218 |
| 3,677,214 | 7/1972 | Bernstein | 114/218 |

FOREIGN PATENT DOCUMENTS

| | | | |
|---|---|---|---|
| 892797 | 3/1962 | United Kingdom | 24/134 R |

OTHER PUBLICATIONS

"Servo"-Aug. 1976.

"Goldberg's" Catalog-p. 150, 1976.

*Primary Examiner*—Edward R. Kazenske

*Assistant Examiner*—D. W. Keen

*Attorney, Agent, or Firm*—Sprung, Felfe, Horn, Lynch & Kramer

[57] ABSTRACT

The subject of the invention is a sheet cleat, especially for sailboats, whose essential elements are movable gripping jaws which form a gripping gap between them, and whose surface parts cooperating with the sheet consist of rollers having a serration and having a rotation-symmetrical envelope surface. The rollers are freely rotatable about axes which are parallel to the plane of movement of the gripping jaws. The sheet is pressed into the gripping gap with rotation and spreading apart of the rollers, and there it is held fast positively and frictionally, but is easily releasable. In the direction of the tension on the sheet under the usual stress, a locking action takes place; in the opposite direction the sheet can be easily retightened. Reduction of wear and tear on the sheet is the additional effect. A plurality of roller pairs can also be present. An adjustable bearing surface and a likewise adjustable guiding means are provided for the sheet as possible accessory devices.

16 Claims, 9 Drawing Figures

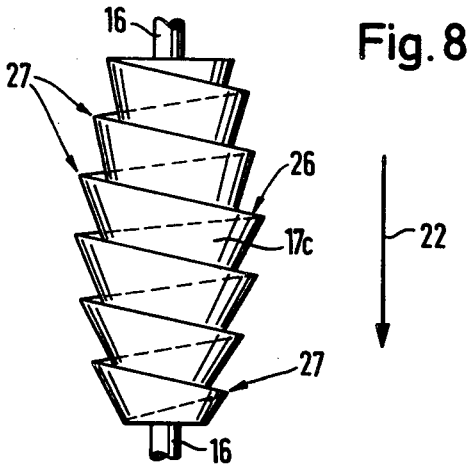
Fig. 8
Fig. 9
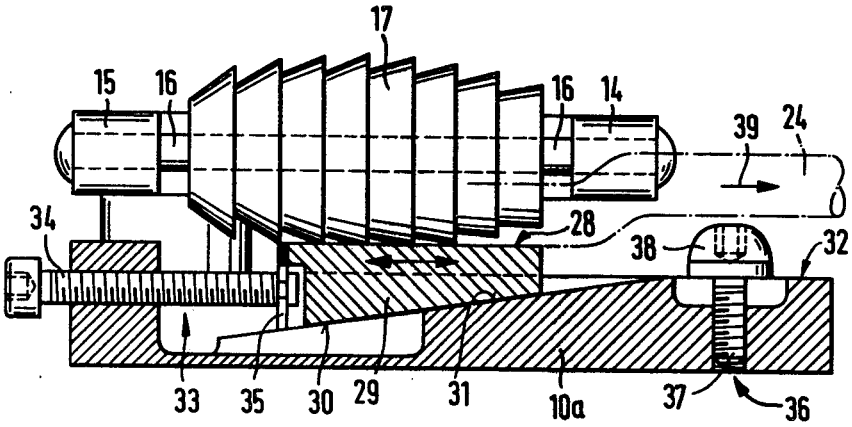

SHEET CLEAT HAVING MOVABLE GRIPPING JAWS

TECHNICAL BACKGROUND

The invention relates to a sheet cleat having two toothed jaws which are movable outwardly and automatically returned by springs. Such sheet cleats are used in sailboats and in other applications, and they serve for belaying or making fast a sheet, such as the jib sheet. The jaws are constructed or movably disposed such that the gap between them has a tendency, produced by a pull on the sheet in one direction, to narrow down and hold the sheet fast, while a pull in the opposite direction enlarges the gap at least to the extent that the sheet can be pulled through substantially freely.

FUNDAMENTAL STATE OF THE ART

One known sheet cleat is called a "Curry cleat." This is a cleat which consists of two jaws pivotingly fastened on a support plate of metal. The toothed, confronting edges of these jaws are set at an angle to one another, so that a narrow, flaring or V-shaped gap is formed between them into which the sheet can be laid. The jaws can pivot outwardly about separate axes, thereby causing the gap between them to be widened for the insertion of the sheet. After the insertion of the sheet, the jaws are swung back again by return springs, so that their toothed gripping surfaces grip the sheet between them. The gripping action is considerably reinforced by the tension on the sheet in the cleat closing direction (self-closing action). By means of such a cleat it is possible to pull the sheet tighter in the direction of the narrow end of the gap (apex of the V), i.e., to shorten it, while it is held fast in the direction of the wide end of the gap.

In a cleat of this kind, it is known to facilitate the insertion of the sheet into the cleat by increasing the height of the jaws and providing the additionally gained gripping surface with a series of inclined grooves. The grooves form at the upper margin of the gripping surface a curved inclined plane. When a pressure is exercised on the sheet, the sheet slides on the inclined plane into the interior of the gap without the need for the exercise of tension on the jaws.

In cleats of this kind there is the serious disadvantage that it is very difficult to release the sheet in an emergency. Under storm wind conditions, a tension of several hundred kilograms is often placed on a sheet, so that a person standing on the opposite side of the boat has to exercise enormous leverage in order to lift the sheet and thus release it from the cleat. Add to this the tight pressure of the jaws on the sheet, and the result may be a loss of time that can ensue in the capsizing of a boat. In addition, the sheet becomes damaged in the long run by being torn out of the toothed cleat, so that it has to be replaced after no more than a single season.

U.S. Pat. No. 3,677,214 discloses another cleat having only one pivoted jaw by which the sheet is urged against a plane surface representing the counter-surface of the jaw. To facilitate the removal of the sheet, the end of the jaw is disposed so as to be able to tilt to a limited degree. This, however, does not facilitate the belaying of the sheet. The one-sided gripping of the sheet combined with the ease with which the sheet can slide on the surface opposite the cleat jaw puts a very heavy stress on the sheet, resulting in premature wear.

DISCLOSURE OF THE INVENTION

It is the object of the invention to create a sheet cleat from which the sheet can be released rapidly and easily in an emergency, and in which it is exposed to no damage even in the event of severe, abrupt tension.

This object is achieved in accordance with the invention, in the sheet cleat described in the beginning, in that at least one freely rotatable roller is disposed in each jaw, the axis of said roller being disposed horizontally and its surface being provided with a profile which forms the teeth. The principle of the invention thus consists substantially in the fact that the "static" teeth of the jaws are replaced by "moving" teeth.

The sheet can be inserted into a sheet cleat of this kind by light pressure, and can be removed again easily by a pull in the transverse direction. Nevertheless, the sheet is reliably held fast when it is under tension in the closing direction, since its longitudinal axis in the state of rest is below a plane passing through two oppositely situated roller axes. This means that the rollers and hence the jaws have to be spread slightly apart when the sheet is removed, and this can be accomplished with little expenditure of force on account of the rolling action. Premature wear by friction against the edges of the teeth is consequently largely prevented.

A cleat of this kind has an especially simple and effective construction if the jaws are in the form of pivoting, C-shaped pieces, the ends of which are pierced by at least one shaft bearing the roller. It is especially desirable that the jaws be journaled on a base plate on pins disposed upright thereon, the axes of the rollers being disposed perpendicular to the said pins.

The oppositely situated axes of the rollers lie in the same horizontal plane, being able to be parallel to one another or to merge V-wise, so that the rollers themselves form a tapering gap between them.

If several pairs of rollers are to be disposed one over the other in the individual jaws of a cleat, it is desirable that the roller axes be mounted at approximately the same distance apart from top to bottom and parallel to one another. Several pairs of rollers have the additional advantage that they form between them several stacked recesses. If the sheet has to be made fast tightly, it can easily be forced by slightly greater pressure into the next lower recess.

At the same time it is possible to construct each jaw in the form of a casing shrouding half or more than half of the rollers longitudinally of their axis. The roller can be mounted in its casing such that the roller axis is located in an imaginary plane outwardly defining the casing. In this case, the one half of the roller is shrouded in the casing, while the other half is always plainly visible. The roller axis, however, can be situated so far in the interior of the cleat jaws or casing, as the case may be, that only a small portion of the surface of the roller is exposed to view. These modes of mounting are referred to as "central axis mounting" and "internal axis mounting."

The rollers can assume any form suitable for the purpose of the invention. For example, the surface of the rollers can be in the form of conic frustums combined to form a sawtooth profile. The surface of the rollers, however, can also be formed in the manner of helical sawtoothing. The envelope surface of these rollers can be, for example, a cylinder, an ellipsoid, a spindle, a barrel or a conic frustum. For a cleat having a flaring gap, the ellipsoidal or spindle shape is especially suitable, while the truncoconical shape is especially suitable for a V-shaped gap.

In addition to a rotation-symmetrical or helical tooth shape, a completely irregular toothing can be used, in the form of knurling. Interengagement of the teeth of opposite rolls is not necessary. The insertion of the sheet can even be facilitated if the confronting teeth are at a slight distance of, for example, less than one millimeter apart. The teeth are best made relatively dull so as to avoid damaging the sheet.

It is desirable that the shafts of the rollers be riveted, screwed or easily removably mounted in the jaws, so that the rollers can easily be replaced. The preferred material for making the rollers is aluminum or relatively soft plastic, such as polyamide or phenolic resin. This has the advantage of low cost of manufacture and of minimizing damage to the sheet. Furthermore, the total weight of the cleat will thus be lower than the weight of known cleats. Since a boat normally has 20 or more cleats, the result is a saving in weight which is of great importance to racing sailors.

The sheet can be removed easily from the cleat of the invention because its removal is quite simply a reversal of its insertion. When the sheet is to belayed, it is first passed over the round surface of the rollers above their axis, and then a slight pressure against the rollers will spread the cams apart allowing the sheet to roll past the gap between the rollers at their point of nearest approach; when the sheet is to be released, it is lifted against the underside of the rollers and then merely has to overcome the gap from below, which requires a relatively slight expenditure of force.

It is especially advantageous to provide the base plate with an adjustable bearing surface for the sheet between the confronting rollers and below the axes of the lowermost rollers (when more than one pair of rollers is involved). This bearing surface can advantageously be part of a sliding body having an inclined plane engaging a corresponding inclined plane provided on the base plate, and an adjusting means acting in the downhill direction of the inclined plane. In this manner the sheet can be brought to an optimum position in relation to the jaws or rollers when it is in its lowermost position. Furthermore, the cleat can be adjusted to different sheet diameters.

It is furthermore advantageous to provide a guiding means for the sheet which is adjustable for height on the side of the space between the cleat jaws facing away from the direction of tension of the sheet and beyond the end of the rollers. This guiding means can best be a screw with a mushroom shaped head which can be turned into and out of the base plate. When this guiding means is appropriately adjusted, it facilitates the release of the sheet in case of emergenecy, especially if the sheet is bent at 180° at the end. This is the case, for example, when the sheet is fastened to a "traveler." A light pull on the sheet causes the guiding element to release the sheet from the jaws.

DESCRIPTION OF THE DRAWINGS

FIG. 8 is a top plan view of a single roller having a spiral sawtooth-like surface of a barrel-shaped envelope configuration similar to that represented in FIG. 1, and FIG. 9 is a vertical cross-sectional view taken through the axis of symmetry of a variant of the embodiment represented in FIG. 1, showing an adjustable bearing surface and an adjustable-height guiding means for the sheet.

FIG. 1 shows a bearing plate 10 of approximately trapezoidal plan, which is provided with two pivot pins 12 on the side of its longest boundary surface 11. Gripper jaws 13 are pivotingly mounted on these pins and are in the form of C-shaped pieces whose limbs are indicated at 14 and 15. A shaft 16 passes through each pair of limbs 14 and 15, and a roller 17 is freely rotatable on this shaft.

Figure 1:
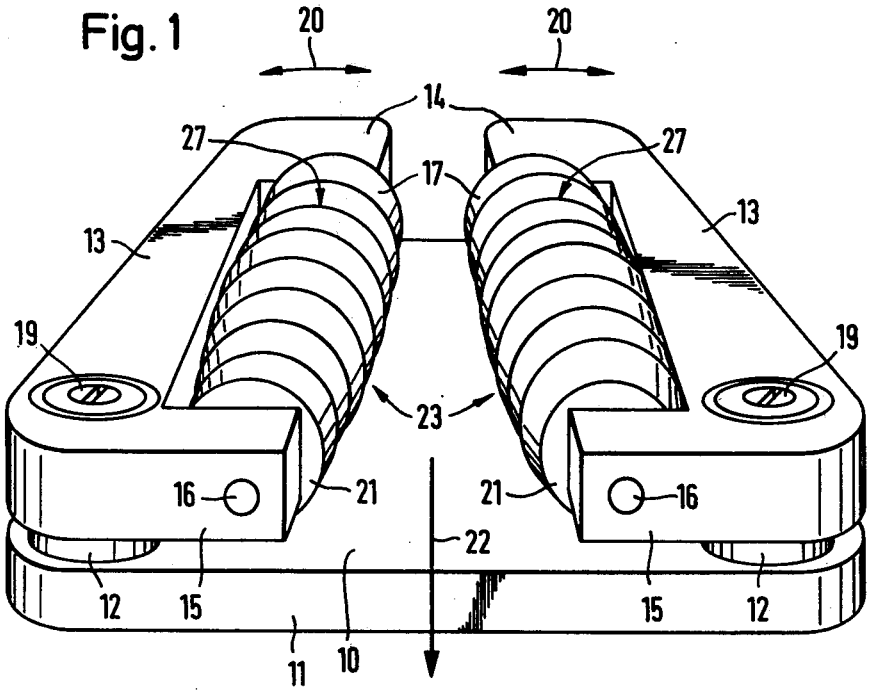
FIG. 1 is a perspective representation of a complete sheet cleat in accordance with the invention, having two rollers of a barrel-shaped envelope configuration.
Figure 2:
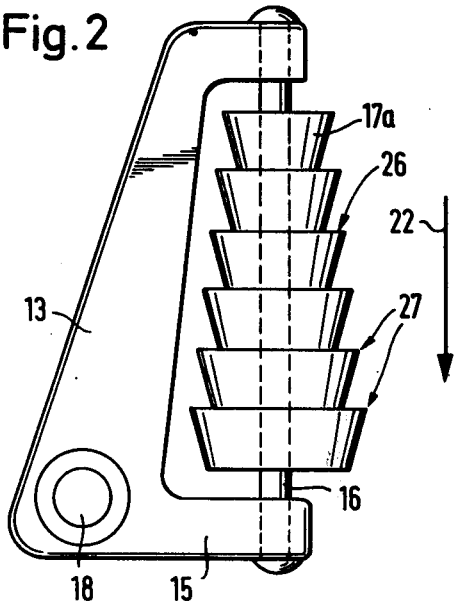
FIG. 2 is a top plan view of a cleat jaw having a roller of truncoconical envelope configuration.
Figure 3:
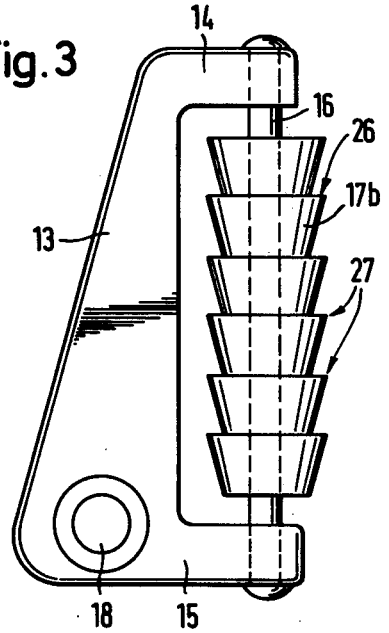
FIG. 3 is a top plan view of a cleat jaw having a roller whose envelope configuration is cylindrical.

The gripper jaws 13 have approximately the forms represented in FIGS. 2 and 3, and they have adjacent one limb 15 a bore 18 whereby they are fastened by means of screws 19 onto the pivot pins 12. The axes of the pivot pins 12 and screws 19 are perpendicular to the bearing plate 10, so that the gripper jaws 13, whose common plane of symmetry is parallel to the bearing plate 10, are able to pivot parallel to the bearing plate 10 in the directions indicated by the double arrows 20. The pivot axes are forward of the end surfaces 21 of rollers 17 as seen in the viewing direction of FIG. 1. The effect of this arrangement is that a pull in the direction of arrow 22 on the sheet laid in the position of this arrow between the rollers 17 will have the tendency to narrow the gap 23 formed between the rollers 17. Vice versa, the action of a force contrary to the direction of the arrow 22 will tend to widen the gap 23. In the vicinity of the pivot pins 12 and screws 19 are situated return springs, which are not shown in FIG. 1 (they are state of the art), and which bias the gripper jaws 13 to narrow the gripping gap 23.

The rollers 17, each made in one piece, have a surface which can be considered to be composed of conic frustums whose planar end surfaces are facing in the direction of the arrow 22. The envelope surface of the rollers can be considered as ellipsoidal or barrel-shaped.

The gripper jaws 13 of FIGS. 2 and 3 differ from the corresponding details of FIG. 1 only in that the roller **17*a* (FIG. 2) has a truncoconical envelope surface, while the roller 17*b* (FIG. 3**) has a cylindrical envelope surface.

Figure 4:
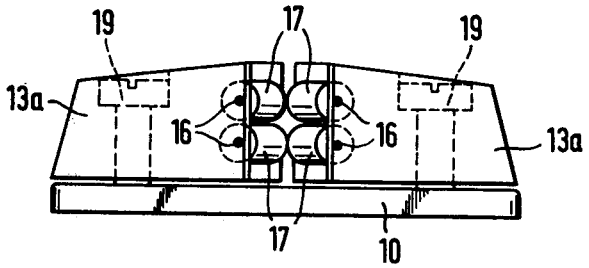
FIG. 4 is a side elevational view taken in the direction of the narrowing gap of a cleat having two pairs of rollers in a vertically stacked arrangement.
Figure 5:
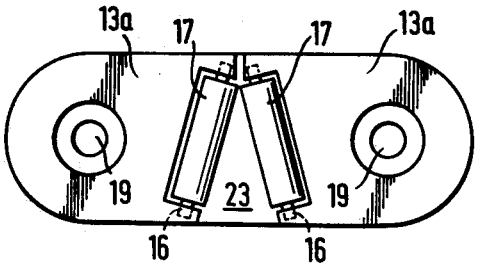
FIG. 5 is a top plan view of the subject of FIG. 4.

In FIG. 4, the bearing plate 10 is provided with two jaws **13*a*, in whi. h two pairs of rollers 17 are stacked one over the other. The axes 16 of these rollers lie in planes which are parallel to the bearing plate 10. The rollers 17 each disposed in a gripper jaw 13*a* lie in planes perpendicular to the bearing plate 10, the two vertical planes being at an angle to one another as illustrated in FIG. 5**.

Figure 6:
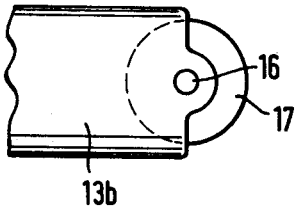
FIG. 6 is a partial side elevational view of a gripper jaw in which half of the circumference of a roller is shrouded.

FIG. 6 shows part of a gripper jaw **13*b* which is in the form of a casing covering one-half of the roller 17, the plane of bisection being on the axis 16**.

Figure 7:
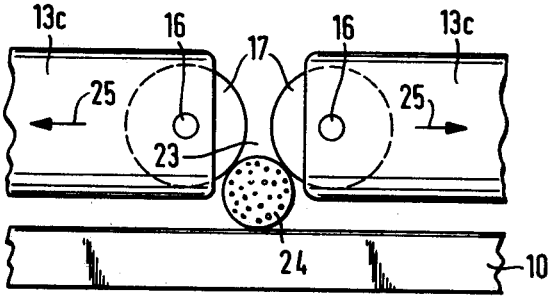
FIG. 7 is a partial side elevational view of two gripper jaws in conjunction with a belayed sheet, the rollers having more than half of their circumference shrouded.

FIG. 7 shows parts of two gripper jaws 13c which are also in the form of casings and cover more than half of the rollers 17. Between the rollers 17 there is represented a sheet 24 which rests on the bearing plate 10 in contact with the two rollers 17, the axis of the sheet, which is perpendicular to the plane of the drawing, lying below a plane laid through the axes 16. To place the sheet 24 in this position or free it therefrom, the sheet must be passed through the narrowest gap between the two rollers 17, and for this purpose the gripper jaws 13c must be spread apart in the direction of the two arrows 25.

FIG. 8 shows a roller 17c whose surface is made in the form of a helical sawtooth configuration, the substantially planar faces 26 of the sawtooth profile formed thereby facing away from the direction of tension on the sheet (arrow 22). Like the rollers of FIGS. 2 and 3, teeth 27 are formed also in the roller 17c as shown in FIG. 8, and their outermost edges are slightly rounded to prevent damage to the sheet. The envelope surface of the teeth 27 in FIG. 8 is ellipsoidal or barrel-shaped.

FIG. 9 shows a bearing plate 10a which is provided with an adjustable bearing surface 28 between the confronting rollers 17 and below the axes 16 of these rollers, i.e., in the vertical plane of symmetry of the entire cleat, the sheet 24 being shown here in broken lines. The bearing surface 28 is part of a slide 29 having an inclined plane 30 in contact with a corresponding inclined plane 31 of the bearing plate 10a. When the slide 29 is shifted in the direction of the double arrow, the distance between the bearing surface 28 and the upper boundary surface 32 of the bearing plate 10 can be continuously varied, thereby making the cleat adjustable for variation of the gripping action and/or for different diameters of the sheet 24. The slide 29 is displaced by means of an adjusting means 33 which consists of a threaded spindle 34 mounted in the bearing plate 10a positively engaged in the slide 29 at a slot 35 which permits the upward and downward movement of the slide.

Furthermore, at the end of the gap or at a point beyond the ends of the rollers 17 in the direction opposite that of the tension on the sheet 24, there is provided a means 36 adjustable in height for the guidance of the sheet. This guiding means is a screw 37 having a mushroom shaped head 38 which can be screwed in and out of the bearing plate 10a. It can be seen that by this guiding means the sheet 24 can be deflected to various heights with respect to the bearing plate 10a, and the means can be set to such a height that the sheet can be drawn out of the gap by a slight tug in the direction of the arrow 39.

We claim:

1. In a sheet cleat having a bearing surface and two confronting jaws pivotably mounted for angular displacement in a plane parallel to the bearing surface towards and away from each other and spring biased towards each other and having teeth for gripping a sheet, the improvement wherein the teeth of each jaw comprise at least one roller mounted for free rotation on its corresponding jaw and movable therewith, each roller having the axis of rotation thereof disposed in a plane parallel to the bearing surface and having a surface provided with a profile forming the teeth.

2. Sheet cleat of claim 1, wherein the surface of the rollers is composed of conic frustums uniting to form a sawtooth profile, the substantially planar end faces of the sawtooth profile facing away from the direction of tension on the sheet.

3. Sheet cleat of claim 1, wherein the surface of the rollers is constructed as a helical sawtooth, the substantially planar end faces of the sawtooth profile facing away from the direction of tension on the sheet.

4. Sheet cleat of claim 1, wherein the axes of confronting rollers are disposed V-wise to one another in the rest position.

5. Sheet cleat of claim 1, wherein a plurality of rollers are disposed one over the other in each gripper jaw, the axes of the rollers of each jaw being disposed parallel to one another.

6. Sheet cleat of claim 1, wherein the gripper jaws comprise casings covering one half of each roller.

7. Sheet cleat of claim 1, wherein the gripper jaws comprise casings covering more than one-half of the rollers (17).

8. Sheet cleat of claim 1, wherein the envelope surface of the rollers is an ellipsoid.

9. Sheet cleat of claim 1, wherein the envelope surface of the rollers is a conic frustum.

10. Sheet cleat of claim 1, wherein the envelope surface of the rollers is a cylinder.

11. Sheet cleat of claim 1, wherein the gripper jaws comprise pivotable C-shaped members having arms and at least one shaft connected to the arms and bearing said roller.

12. Sheet cleat of claim 11, further comprising a base plate having an upper surface defining the bearing surface and on which the gripping jaws are pivotally mounted by pivot pins aligned perpendicular to the bearing surface, and that the axes of the rollers are disposed perpendicular to the pivot pins.

13. Sheet cleat of claim 12, wherein the bearing surface is disposed between the confronting rollers and below the axes of the lowermost rollers and wherein the cleats further comprise means for adjusting the height of the bearing surface relative to the axes of the rollers.

14. Sheet cleat of claim 13, wherein the adjusting means comprises a slide body having the bearing surface on top thereof and an inclined plane on the bottom thereof, a corresponding inclined plane on the base plate and manual adjusting means acting in the direction of slope of the inclined plane.

15. Sheet cleat of claim 12, further comprising a height-adjustable guiding element for the sheet is disposed on the side of the gripping gap facing away from the direction of tension of the sheet and beyond the end of the rollers.

16. Sheet cleat of claim 15, wherein the guiding element for the sheet is a screw with a mushroom-shaped head and which is threadably engageable into and out of the base plate.

* * * * *